United States Patent [19]

Voza

[11] 4,408,640

[45] Oct. 11, 1983

[54] METHOD AND APPARATUS FOR FILLING A CONTAINER

[75] Inventor: Alfonse N. Voza, Jersey City, N.J.

[73] Assignee: The Singer Company, Stamford, Conn.

[21] Appl. No.: 314,604

[22] Filed: Oct. 26, 1981

[51] Int. Cl.[3] ..... B65B 3/04

[52] U.S. Cl. ..... 141/1; 141/95; 68/12 R; 134/57 D

[58] Field of Search ..... 134/57; 68/207, 12 R; 141/1, 94, 192, 95, 96, 198–229, 2–12; 222/23, 26, 52, 64, 70

[56] References Cited

U.S. PATENT DOCUMENTS 3,823,846 7/1974 Probst .
4,006,840 2/1977 Shannon .
4,252,252 2/1981 Gross et al. .

FOREIGN PATENT DOCUMENTS 2818062 3/1980 Fed. Rep. of Germany ..... 68/12 R

*Primary Examiner*—Houston S. Bell, Jr.
*Attorney, Agent, or Firm*—David L. Davis; Robert E. Smith; Edward L. Bell

[57] ABSTRACT

To fill a container with a predetermined volume of liquid, initially the time required to fill the container with an elemental volume is measured and the filling is continued for a multiple of the measured time, the multiple corresponding to the predetermined volume as a function of the elemental volume. Accordingly, any variations in inlet pressure are adapted to and compensated for.

3 Claims, 2 Drawing Figures

METHOD AND APPARATUS FOR FILLING A CONTAINER

DESCRIPTION

BACKGROUND OF THE INVENTION

This invention relates to the art of liquid dispensing and, more particularly, to a method and apparatus for filling a container with a predetermined volume of liquid.

This invention has particular utility to automatic dishwashers. It is conventional to fill an appliance of this type by opening up an inlet valve in the water line for a preset time interval. However, this technique possesses the disadvantage that the amount of water entering the dishwasher during this preset time interval is dependent upon the inlet water pressure and, accordingly, the amount of water actually entering the dishwasher is not predictable with any degree of certainty. Alternatively, a water level sensor could be provided and the inlet valve would then be opened until the water level sensor is triggered. However, during the operation of an automatic dishwasher there may be a number of fill cycles, each of which may require a different amount of water. Thus, several level sensors may be required, adding to the expense of the dishwasher. Additionally, it would be desirable to allow the user to select a water level dependent upon the load placed in the dishwasher, e.g., light, normal, or heavy loads. This would also require a number of water level sensors or else be subject to the vagaries of water pressure.

It is therefore an object of this invention to provide an economical means for filling a dishwasher with a predetermined volume of water which is not dependent upon water pressure or a large number of water level sensors for predictable results.

SUMMMARY OF THE INVENTION

The foregoing and additional objects are attained in accordance with the principles of this invention by providing a method for filling a container with a predetermined volume of liquid, there being a controllable flow valve intermediate a source of the liquid and the container, the method comprising the steps of opening the valve, providing a signal when an elemental volume of the liquid is in the container, timing the interval between the valve opening and the signal provision, providing an indication of the predetermined volume as a multiple of the elemental volume, timing a period commencing with the providing of the signal and terminating at the multiple less one times the interval determined in the preceding timing step, and closing the valve at the termination of the period timed in the second timing step.

This invention may also be practiced by providing apparatus for filling a container from an inlet fluid line comprising an electrically operated open/shut valve in the inlet fluid line, a fluid level sensor within the container arranged to provide an electrical signal when the fluid level within the sensor reaches a predetermined reference level corresponding to an elemental volume, opening means for providing an electrical open signal to open the valve, first timing means for timing an elemental interval commencing with the opening of the valve and terminating with the provision of the electrical signal, level selector means for selecting a desired container fill volume as a multiple of the elemental volume, second timing means for timing an overall fill interval equal to the elemental interval times the multiple, and shutting means responsive to the termination of the overall fill interval for providing an electrical shut signal to shut the valve.

In accordance with an aspect of this invention, the opening means, the first timing means, the level selector means, the second timing means and the shutting means are together implemented by a programmed microcomputer.

BRIEF DESCRIPTION OF THE DRAWINGS

The foregoing will be more readily apparent upon reading the following description in conjunction with the drawings wherein.

DETAILED DESCRIPTION

Figure 1:
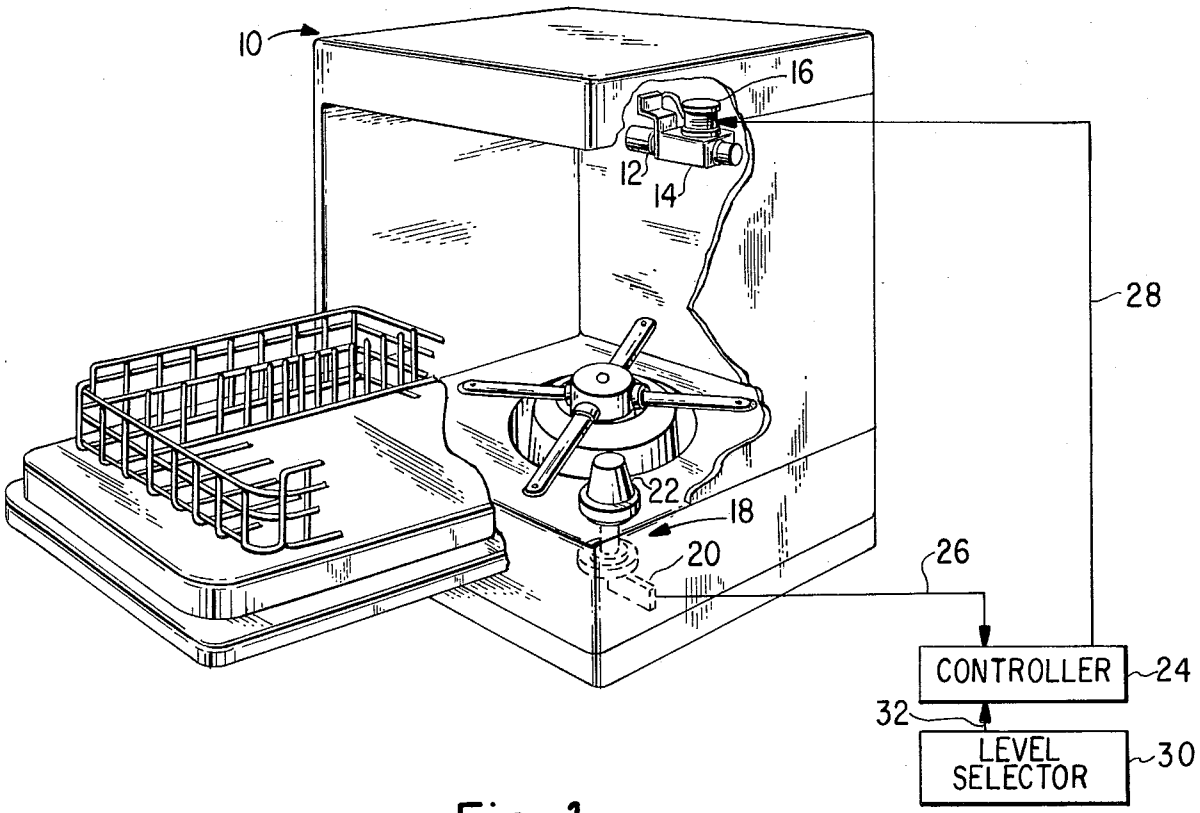
FIG. 1 is a schematic representation of an automatic dishwasher wherein the filling thereof with water is controlled in accordance with the method and apparatus of this invention.

Referring now to the drawings, FIG. 1 illustrates a dishwasher, designated generally by the reference numeral 10, wherein the amount of water entering the dishwasher 10 during any of the fill cycles thereof is controlled in accordance with the principles of this invention. Thus, the dishwasher 10 is connected to a source of water through a water inlet line 12. A valve unit 14 is inserted in the inlet line 12. The valve unit 14 is an electrically operated open/shut valve of conventional construction and illustratively includes an electrically operated solenoid 16, the energization of which controls the open/shut condition of the valve element within the valve unit 14 to control the flow of water through the inlet line 12 into the dishwasher 10.

The dishwasher 10 also includes a water level sensor unit 18 which includes a microswitch 20 and a float element 22. The float element 22 and the microswitch 20 are operatively connected together in a conventional manner so that when the water level within the dishwasher 10 reaches some predetermined level, the float 22 rises to close (or alternatively open) the microswitch 20.

In accordance with the principles of this invention, there is provided a controller 24 which receives signals from the microswitch 20 over the lead 26 and provides open/shut electrical signals to the solenoid 16 of the valve unit 14 over the lead 28. A level selector 30 is also provided. The level selector 30 is user actuated to provide an indication to the controller 24 over the lead 32 of the desired relative fill level such as, for example, for a light load, a normal load or a heavy load of dishes. The level selector 30 may illustratively comprise an array of pushbuttons or alternatively may be an adjustable dial.

Figure 2:
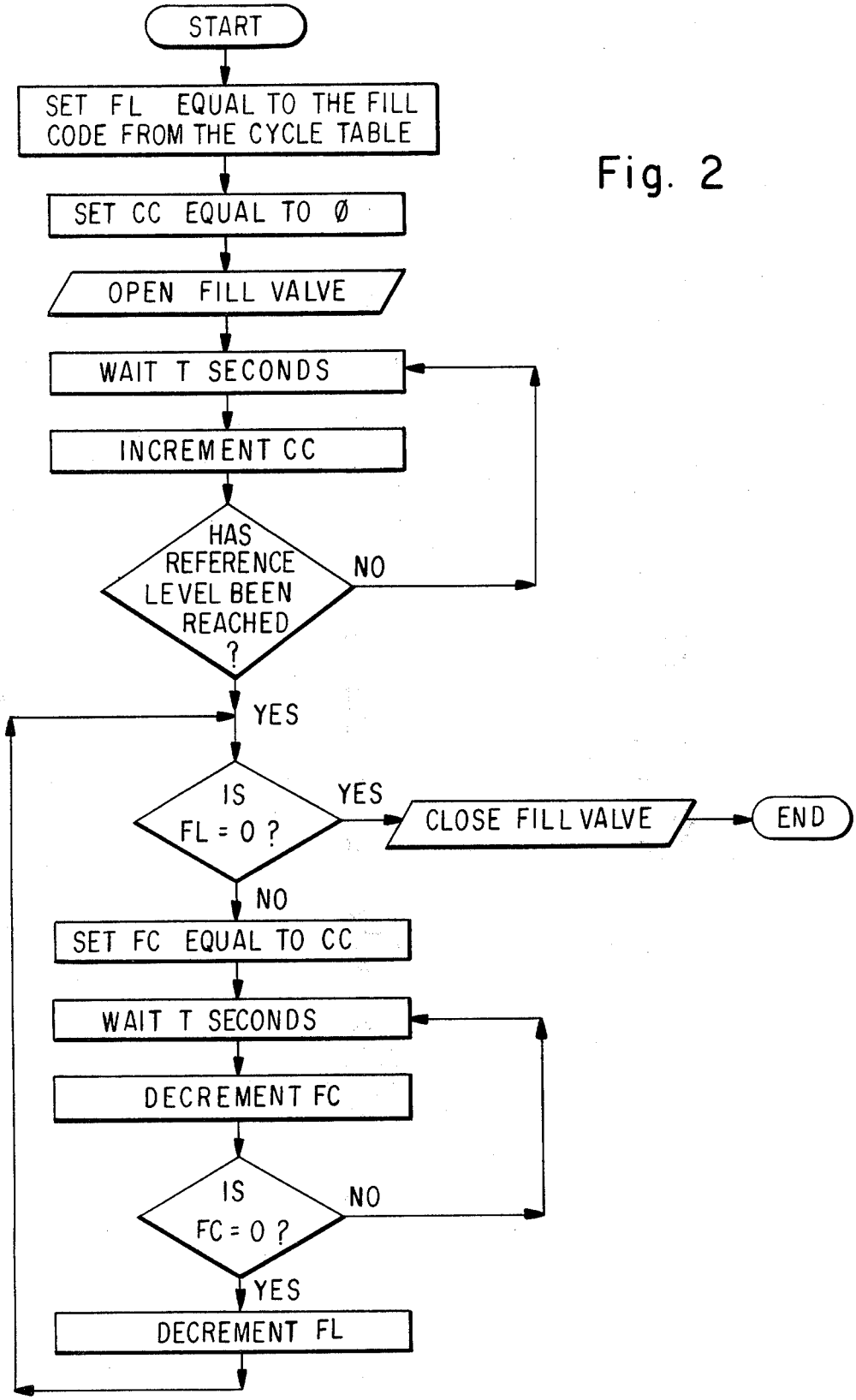
FIG. 2 is a flow chart illustrating the operation of the system of FIG. 1 in accordance with the principles of this invention.

Preferably, the controller 24 is a programmed microcomputer, although this invention may be practiced by appropriately designed hard wired logic circuitry. FIG. 2 is a flow chart of a subroutine illustrating the operation of the controller 24 in accordance with the principles of this invention. Within the controller 24 there are several registers and/or counters which are utilized during the subroutine shown in FIG. 2. These registers are the calibration counter (CC), the fill counter (FC) and the fill level register (FL). Within the controller 24 there is a cycle table which contains a fill level number for each cycle of the dishwasher 10, depending upon the load as set by the level selctor 30. When the subroutine shown in FIG. 2 is entered, the register FL is set equal to the fill level code taken from the cycle table. The total fill volume will be equal to (FL+1) times the elemental volume of water that it takes to operate the water level sensor 18. Next, the calibration counter (CC) is set equal to zero and the valve 14 is opened. An interval of T seconds is then timed, at the end of which the calibration counter CC is incremented. The time T may be any arbitrary time unit, the smaller it is the greater the precision of the system. After the calibration counter CC is incremented, the controller 24 checks to see whether the reference level as determined by the sensor unit 18 has been reached. If not, another interval of T seconds is timed and the calibration counter CC is again incremented. Accordingly, the calibration counter CC is incremented until the elemental volume of water is within the dishwasher 10. At this time, the fill level register FL is examined to see if it is zero. If so, this indicates that no more water is required and the valve 14 is signalled to shut off the inlet line 12. If the fill level register FL is not equal to zero, the fill counter FC is set equal to the contents of the calibration counter CC. An interval of T seconds is then timed, the fill counter FC is decremented, and the fill counter FC is checked to see whether it has reached zero. If not, another interval of T seconds is timed and the fill counter FC is again decremented. Thus, an interval of time equal to the initial elemental volume fill time interval is timed, and at the end of this interval, the fill level register FL is decremented. The subroutine then loops around and checks whether the fill level register FL is equal to zero. If so, the fill valve unit 14 is closed and the subroutine is exited. Otherwise, more intervals are timed.

In summary, the calibration counter CC is set to zero when the fill valve 14 is opened. CC counts up until the reference level is reached, this reference level corresponding to an elemental volume of water. The fill valve is then left open for FL times CC additional counts. Thus, the time to fill up to the reference level (corresponding to the elemental volume of water) is equal to CC times T seconds. The total fill time equals (CC times T)+(FL times CC times T) or (FL+1) times (CC times T) seconds and the total fill volume is equal to (FL+1) times the elemental volume.

Accordingly, there has been disclosed an improved method and apparatus for filling a container from a source to a predetermined level. This technique is independent of inlet pressure and requires a minimum number of level sensors (i.e. only one). It is understood that the above-described embodiment is merely illustrative of the application of the principles of this invention. Numerous other embodiments may be devised by those skilled in the art without departing from the spirit and scope of this invention, as defined by the appended claims. Thus, although a dishwasher has been disclosed, it is apparent that this invention may be applied to the filling of any type of container, such as for example, a clothes washer. Additionally, although a microcomputer and a subroutine therefor has been disclosed, it is apparent that hard wired circuitry may also be utilized in carrying out this invention. Further, although this invention has been described with reference to an integral multiple of elemental volume units, it is apparent that with the computing power of a microcomputer, other than integral multiples are possible.

I claim:

1. A method for filling a container with a predetermined volume of liquid, there being a controllable liquid flow valve intermediate a source of the liquid and the container, the method comprising the steps of:

(a) opening the valve;

(b) providing a signal when an elemental volume of the liquid is in the container;

(c) timing the interval between the valve opening and the signal provision;

(d) providing an indication of said predetermined volume as a multiple of said elemental volume;

(e) timing a period commencing with the providing of said signal and terminating at said multiple less one times the interval determined in step (c); and (f) closing the valve at the termination of the period timed in step (e).

2. Apparatus for filling a container from an inlet fluid line comprising:

an electrically operated open/shut valve in the inlet fluid line;

a fluid level sensor within the container arranged to provide an electrical level signal when the fluid level within the container reaches a predetermined reference level corresponding to an elemental volume;

opening means for providing an electrical open signal to open said valve;

first timing means for timing an elemental interval commencing with the opening of said valve and terminating with the provision of said electrical level signal;

level selector means for selecting a desired container fill volume as a multiple of said elemental volume;

second timing means for timing an overall fill interval equal to said elemental interval times said multiple; and shutting means responsive to the termination of said overall fill interval for providing an electrical shut signal to shut said valve.

3. The apparatus according to claim 2 wherein said opening means, said first timing means, said level selector means, said second timing means and said shutting means are together implemented by a programmed microcomputer.

* * * * *